United States Patent [19]

Marontate

[11] 4,357,979

[45] Nov. 9, 1982

[54] SKIRTED ACCORDION FOLDING DOORS

[76] Inventor: John D. Marontate, Box 346, Forest Grove, Oreg. 97116

[21] Appl. No.: 243,129

[22] Filed: Mar. 12, 1981

[51] Int. Cl.[3] ..... A47H 5/00

[52] U.S. Cl. ..... 160/84 R

[58] Field of Search ..... 160/84 R, 183, 196, 160/199, 206, 40, 231 A; 49/488, 493

[56] References Cited

U.S. PATENT DOCUMENTS

| | | | |
|---|---|---|---|
| Re. 25,112 | 1/1962 | Collins | 160/199 |
| 1,159,867 | 11/1915 | Rands | 49/488 |
| 1,560,097 | 11/1925 | Petersen | 49/488 |
| 2,746,540 | 5/1956 | Dixon, Jr. | 160/206 |
| 2,903,055 | 9/1959 | Merrill | 160/40 |
| 2,949,651 | 8/1960 | Hill | 49/493 |
| 3,024,504 | 3/1962 | Miller | 49/488 |
| 3,033,283 | 5/1962 | Jorgensen | 160/183 |
| 3,098,519 | 7/1963 | Myers et al. | 160/40 |
| 3,126,048 | 3/1964 | Hollands | 160/40 |
| 3,223,147 | 12/1965 | Holloway | 160/84 |
| 3,227,205 | 1/1966 | Crosswell | 160/40 |
| 3,234,996 | 2/1966 | King et al. | 160/231 A |
| 3,348,628 | 10/1967 | Dixon et al. | 181/33 |
| 3,349,829 | 10/1967 | Dixon | 160/40 |
| 3,575,229 | 4/1971 | Alley | 160/1 |
| 3,654,730 | 4/1972 | Fraleigh | 49/34 |
| 3,672,424 | 7/1972 | Brown | 49/488 |
| 3,783,930 | 1/1974 | Williams | 160/206 |
| 4,015,368 | 4/1977 | Court et al. | 49/488 |

*Primary Examiner*—Peter M. Caun

*Attorney, Agent, or Firm*—Eugene D. Farley

[57] ABSTRACT

A skirted, hinged panel, accordion folding door. A base member is attached to the end of each panel. Each base member mounts a plurality of guides. A flexible seal strip extends continuously along the ends of the panels. It includes an engaging bead configured to engage with the guides, and a flexible band attached to the bead and extending substantially to the adjacent structural surface to seal against the transmission of air, heat, light and sound.

3 Claims, 3 Drawing Figures

SKIRTED ACCORDION FOLDING DOORS

BACKGROUND OF THE INVENTION

This invention relates to folding doors, and more particularly to means for sealing around the top and bottom edges of folding doors in their extended condition.

Folding doors of the general class of the present invention are well known and widely used for various purposes, especially for subdividing floor areas in buildings. When such doors are fully extended to subdivide and completely separate a given area into smaller subdivisions, the problem of insulating one subdivision relative to the other becomes particularly important. It is desirable to insulate them, as far as possible, against the transmission of air, heat, light, sound and the like.

In an effort to provide such insulation, it has been the practice heretofore to provide a vertical air seal at each of the end posts with respect to the door jambs or with respect to the end post of a cooperating door where two folding doors cooperate in closing a particular opening or doorway.

However, it also is desirable to provide insulation at the tops and bottoms of the doors, since the upper and lower edges of folding doors are normally spaced a small distance from the top of the doorway opening and from the floor. To meet this problem, flexible horizontally disposed sweep strips are customarily provided along both the upper and lower edges of the doors so that an air seal is also provided along these edges.

Such prior art sweep strips are formed from bands of flexible material which are stapled or sewn to the top and bottom edges of the door. Other designs include foam pads pressed against the structural surfaces adjacent the edges of the doors. Sweep strips of these prior art designs are difficult to install during manufacture, and almost impossible to replace when they get damaged or worn with age. Replacement may require removal and rebuilding of the folding door structure.

Further complications derive from the particular construction of the door. Generally, two types of folding doors are found in conventional use. One type employs a lazy-tong framework covered on each side by a flexible sheet of cloth, vinyl, or the like. The other type employs a plurality of hinged solid panels constructed of laminated wood and hinged with vinyl stips. On this latter type it is difficult to hide the sewing or stapling attachment of conventional sweep strips.

Accordingly, it is the general object of the present invention to provide a skirt or sweep strip assembly for use with an accordion folding door.

Another object is to provide a skirt assembly which insulates against the transmission of air, odors, heat, light and sound.

Yet another object is to provide a sweep strip which is easy to install during manufacture and easy to replace.

A further object is to provide a skirt assembly for use with a vertically hinged solid panel accordion folding door which enhances the visual appearance of the door.

Another object is to provide a skirt assembly which is symmetrical, strong and durable and does not interfere with the normal operation of the door to which it is attached.

These and other objects and advantages of the present invention and the manner in which they are accomplished will become apparent in the following specification and claims.

SUMMARY OF THE INVENTION

In its basic concept, the present invention is a skirt or sweep strip assembly for use in combination with an accordion folding door. The skirt assembly includes a base member attached to one or both ends of each of the articulated panels of the door.

The base members mount seal strip support means which in turn mount a flexible seal strip extending continuously along the ends of the panels. The seal strip includes an engaging means configured to engage the seal strip support means, and a flexible band attached to the engaging means and extending across the space to be sealed substantially to the adjacent structural surface.

DESCRIPTION OF THE PREFERRED EMBODIMENT

Figure 1:
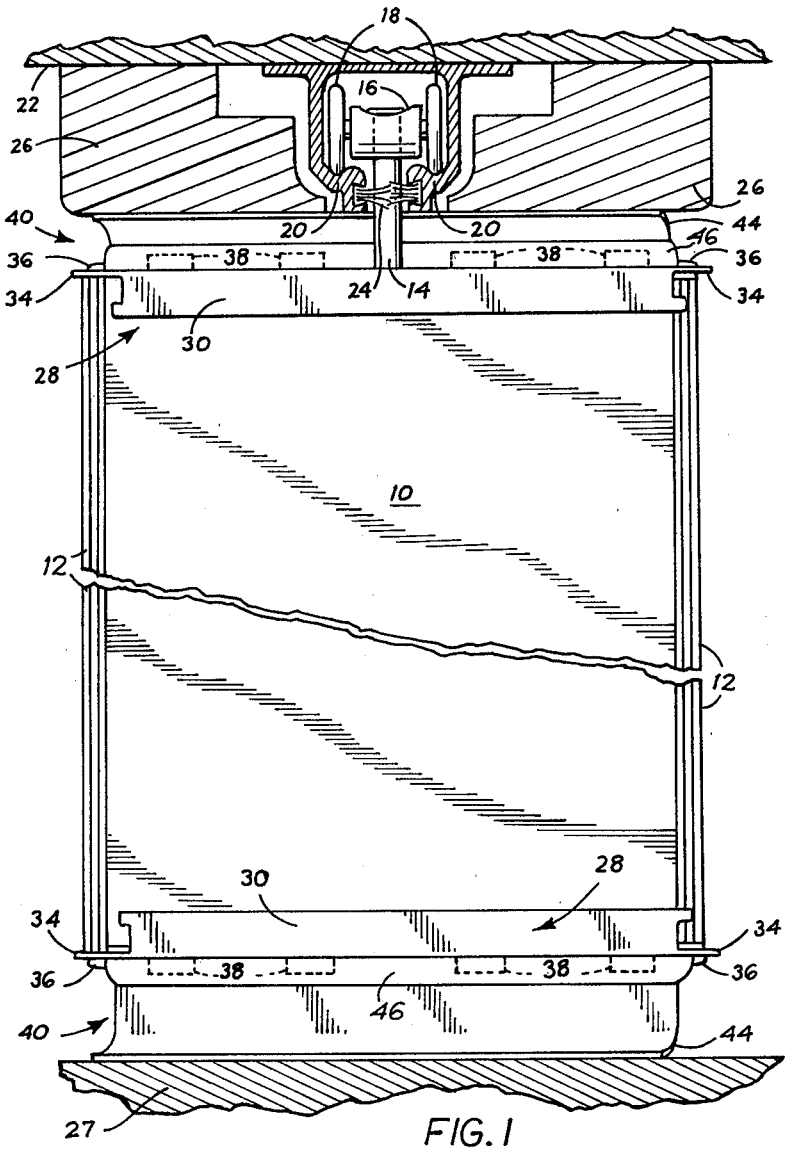
FIG. 1 is a foreshortened elevation of an accordion folding door in folded condition including the skirt assembly of the present invention.

As shown in FIG. 1, the folding door of the present invention includes a plurality of solid panels 10 which are preferably of wood, and are hinged together by vinyl connectors 12.

The panels are supported by a plurality of posts 14 which are attached to alternate panels as hereinafter discussed, and which mount a carriage 16 having wheels 18 which ride in a track 20. The track is attached to door lintel 22 or a similar overhead support. The track includes fin-seal stripping 24 which conforms to posts 14 to make operation of the track more quiet.

Moldings 26 extend around track 20 as shown in FIG. 1, and form a smooth structural surface substantially co-planar with the bottom of the track.

Floor 27 forms the structural surface below panels 10.

Figure 3:
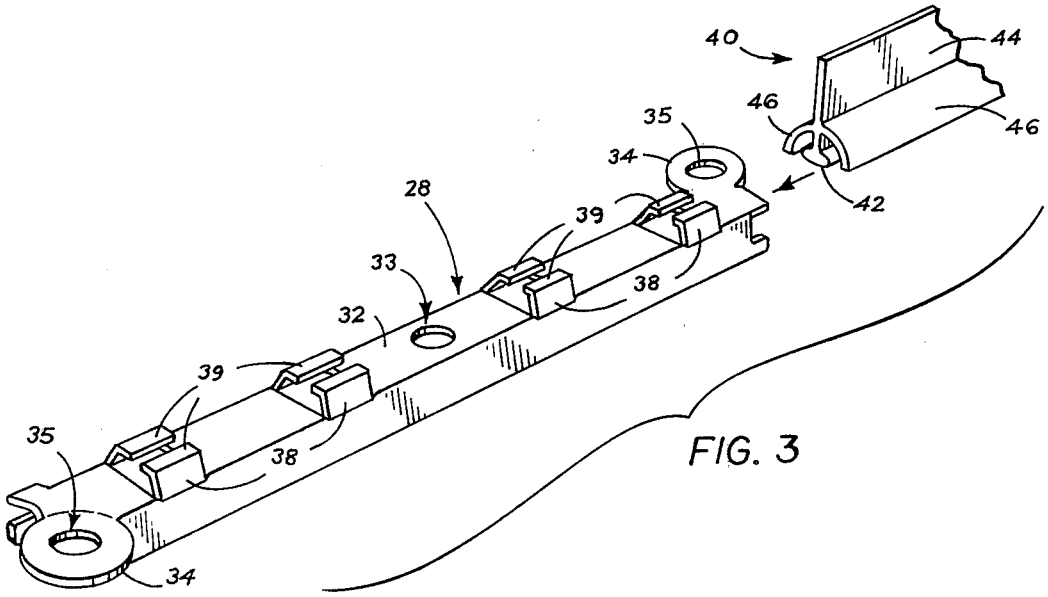
FIG. 3 is a perspective view of the skirt assembly of the present invention, including the base or hinge member on which it is mounted, and a fragmentary portion of the seal strip.

Attached to the top and bottom of each panel 10 is a skirt assembly including a base or hinge member 28 which is best shown in FIG. 3. The base member includes sidewalls 30 and outside edge 32. The sidewalls are configured to be clamped onto an end of a panel 10.

A hole 33 in the center of the outside edge 32 receives post 14 for attachment of the panels 10 to carriage assembly 16. Not every base member is attached to a corresponding post; rather, all base members may be configured similarly for ease of manufacture, but only selected ones need have the post attachment.

Each base or hinge member 28 is preferably elongated to extend substantially the length of the end of panel 10. At the ends of each base member are hinge knuckle-forming extensions 34. Each knuckle-forming extension has a hole 35 therethrough for attachment to an adjacent hinge or base member by means of a pin 36 (FIG. 1). This forms an articulated chain of hinge members which interconnects the panels as well as vinyl connectors 12.

As best shown in FIG. 3, on the outside edge 32 of base member 28 is a seal strip support means including a guide 38 having upstanding and inwardly projecting tabs 39. Preferably a plurality of such guides are provided along the length of the elongated base member.

A flexible seal strip 40 extends continuously along the ends of the hinged panels 10 of the door. It includes an engaging means or bead 42, and a flexible band or skirt 44 extending from the bead and dimensioned to extend substantially to and preferably sweep along the adjacent structural surface.

Guides 38 are preferably designed for sliding reception of bead 42 and also to allow band 44 to extend out between the tabs of the guides.

Figure 2:
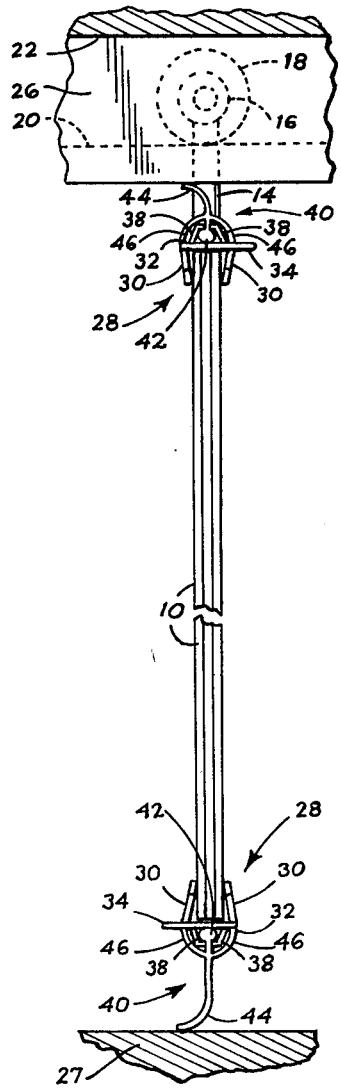
FIG. 2 is a foreshortened end elevation of the door of FIG. 1.

Adjacent bead 42 and formed integrally as part of seal strip 40 is a pair of oppositely directed, arcuate wings 46 extending outwardly around bead 42 and overlapping guides 38 to form a housing for the bead and guides. As best shown in FIG. 2, the wings contact sidewalls 30, thus forming an airtight seal with base member 28.

OPERATION

Panels 10 are interconnected by vinyl connectors 12. Bases or hinge member 28 are attached to the ends of the panels and pinned together through knuckle-forming extensions 34 by pins 36.

The skirt assembly 40 is mounted by threading bead 42 through guides 38, and allowing band 44 to extend out between the tabs of the guides to substantially fill the space between the panels 10 and the adjacent structural surfaces. The bands along the top of the panels and bottom of the panels may be of different widths, and various width seal strips 40 may be used to accommodate a particular installation.

Moldings 26 form a flat structural surface substantially co-planar with the bottom of track 20. Top seal strip 40 sweeps along the moldings as well as along the track. Fin-seal stripping 24 also helps seal the space above the top of the door.

Alternate top base members 28 mount posts 14 which support panels 10 from track 20. Seal strip 40 merely contours around the posts where necessary.

As shown in FIG. 2, the skirt assembly forms a seal between the panels and the adjacent structural surfaces. Wings 46 seal around the attachment of bead 42 and guides 38, completing the seal.

It thus can be seen that the present invention provides a skirt assembly for use with an accordion folding door, and particularly such a door which is made of a plurality of hinged solid panels. The skirt assembly seals against the transmission of air, heat, light and sound. The assembly is easy to install and replace if necessary. Further, the visual appeal of the door is maintained.

Having described my invention in its preferred embodiment, I claim:

1. In combination with an accordion folding door having a plurality of articulated panels, a skirt assembly for sealing the spaces between the top and bottom ends of the panels and the adjacent structural surfaces, the skirt assembly comprising:

(a) an elongated base member attached to each end of each panel and extending substantially the full length of said end, the base member being U-shaped in cross section having spaced side walls extending along the sides of the panel and a connecting outside wall extending across the end of the panel, (b) seal strip support means comprising a pair of laterally spaced tabs extending outwardly from the outside wall of the base member and having inwardly projecting outer ends, the spaced tabs defining a guide groove between them extending in the longitudinal direction of the base member, and (c) an elongated flexible seal strip extending substantially the full length of the base member and including an enlarged bead along one edge received slidably through the guide groove defined by the spaced tabs, the seal strip extending outwardly between the spaced tabs substantially to the adjacent structural surface.

2. The combination of claim 1 wherein the seal strip support means comprise a plurality of pairs of said laterally spaced tabs mounted at longitudinally spaced intervals along the length of the base member.

3. The combination of claim 2 including flexible wings extending outwardly along opposite sides of the flexible sealing strip adjacent said bead and arranged to cover the plurality of spaced tabs of the seal strip support means.

* * * * *